US009622546B2

(12) United States Patent
Turdjian

(10) Patent No.: US 9,622,546 B2
(45) Date of Patent: Apr. 18, 2017

(54) CLAMP FOR ADJUSTABLY JOINING THE ENDS OF A STRAP

(75) Inventor: Crest Turdjian, Los Angeles, CA (US)

(73) Assignee: Moldex-Metric, Inc., Culver City, CA (US)

( * ) Notice: Subject to any disclaimer, the term of this patent is extended or adjusted under 35 U.S.C. 154(b) by 799 days.

(21) Appl. No.: 13/317,329

(22) Filed: Oct. 14, 2011

(65) Prior Publication Data

US 2013/0091668 A1 Apr. 18, 2013

(51) Int. Cl.
*A44B 11/06* (2006.01)

(52) U.S. Cl.
CPC ..... *A44B 11/06* (2013.01); *Y10T 24/45084* (2015.01)

(58) Field of Classification Search
CPC ..... A44B 11/06; Y10T 24/45084; A43C 7/00; A43C 7/04; A43C 7/08
USPC ..... 24/579.11, 578.1, 572.1, 712.1, 712.9, 24/713.2, 197
See application file for complete search history.

(56) References Cited

U.S. PATENT DOCUMENTS 454,756 A * 6/1891 Neuville ..... 24/197
1,806,162 A * 5/1931 Hahn ..... 24/712.6
3,138,839 A * 6/1964 Mathes ..... 24/712.5
3,418,733 A * 12/1968 Tyrrell, Sr. et al. ..... 36/50.1
3,967,347 A * 7/1976 Bickis, Sr. ..... 24/200
4,117,573 A * 10/1978 Nakamura ..... 24/22
4,790,048 A * 12/1988 Arnt ..... 24/712.1
5,426,829 A * 6/1995 Hsiung ..... 24/197
5,504,977 A * 4/1996 Weppner et al. ..... 24/115 R
5,600,875 A * 2/1997 Chang ..... 24/200
5,644,822 A * 7/1997 Frew ..... 24/196
5,671,508 A * 9/1997 Murai ..... 24/115 K
5,829,105 A * 11/1998 Matoba et al. ..... 24/115 F
5,918,352 A * 7/1999 Galbreath ..... 24/712.3
6,675,446 B2 * 1/2004 Buettell ..... 24/122.6
6,871,423 B2 * 3/2005 King, Jr. ..... 36/50.1
7,124,482 B2 * 10/2006 Kim ..... 24/712.1
7,237,307 B2 * 7/2007 Feschuk ..... 24/115 R
2002/0020046 A1 * 2/2002 Voughlohn ..... 24/712.1

* cited by examiner

*Primary Examiner* — Jack W Lavinder
(74) *Attorney, Agent, or Firm* — Charles H. Schwartz

(57) ABSTRACT

A clamp for adjustably joining the ends of a strap having ends. The clamp has top and bottom members, and at least one of the top and bottom members has a groove extending from one side to the other side of the clamp. The groove receives the ends of the strap so first portions of the ends of the strap are within the groove and at least one other second portion of the strap extends outward from the sides of the clamp. Complementary aligning portions are located on the top and bottom members to align the top and bottom members to capture the first portions of the ends of the strap by friction within the groove formed within the clamp. The length of the strap is adjusted by the second portion of the strap that extend outward from the sides of the clamp.

11 Claims, 5 Drawing Sheets

CLAMP FOR ADJUSTABLY JOINING THE ENDS OF A STRAP

BACKGROUND OF INVENTION

The present invention relates to a clamp for adjustably joining the ends of a strap and more particularly to such a clamp that is very simple in construction and can be manufactured as a single molded member. Therefore, the clamp of the present invention is much less complicated than prior art clamps. The clamp of the present invention has specific utility for use with a respirator mask. It is important that with a respirator mask, the strap be adjustable so that the mask can be adjusted for better-fit and proper sealing to the face of the wearer and for comfort during use.

Most prior arts strap clamps are complex in structure and generally include a number of parts and thereby provide for an additional expense in the assembly of those parts. Also, these prior art adjustable strap clamps often include further members such as springs or other additional structures for providing for an adjustment of the length of the ends of the strap to particular desired positions. The present invention is specifically directed to an adjustable strap clamp that is much simpler in construction than the prior art devices.

SUMMARY OF THE INVENTION

The preferred embodiment of the present invention is manufactured using a single injection molded plastic member which would be folded over on itself using a living hinge to provide for the clamping of the ends of the strap member within the interior of the folded over molded plastic member. This clamping of the ends of the strap member is accomplished in a particular manner so as to allow for the adjustment of the ends of the strap member. In particular, the single injection molded member may include complementary protrusions and recesses within the interior of the folded over molded plastic member to provide for clamping of the ends of the strap member to lock them in position. Additionally, the ends of the strap member are held at an initial length by the complementary protrusions and recesses but not held so hard that one or both of the strap ends can be pulled to provide for an adjustment of the strap length. The clamp member may take a variety of forms but essentially all of these forms have a structure similar to that as described above.

DETAILED DESCRIPTION OF THE PREFERRED EMBODIMENTS

Figure 1C:
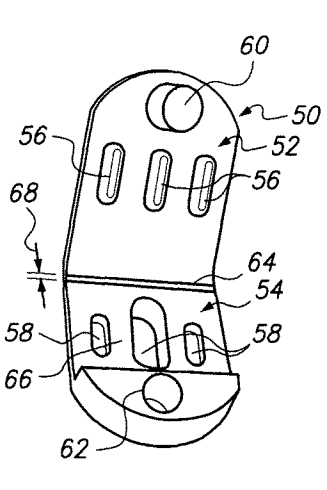
FIGS. 1A, 1B and 1C show three alternative structures for the clamp member of the present invention.
Figure 1B:
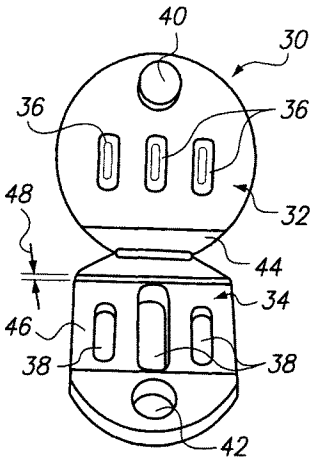
Figure 1A:
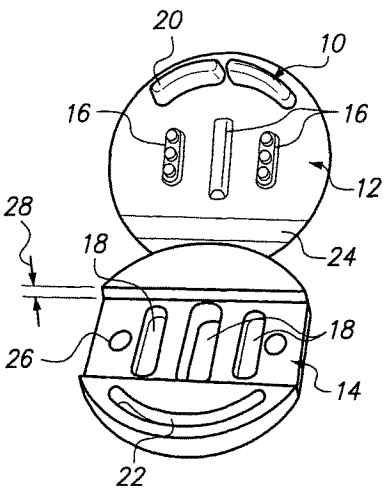

Referring to FIGS. 1A, 1B, and 1C, three alternative forms of the clamp member of the present invention are shown. In FIG. 1A clamp member 10 includes a top member 12 and a bottom member 14 and with the top member 12 including protrusions 16 and with these protrusions 16 lining up with recesses 18 in the bottom member 14. The central one of the protrusions 16 and the central one of the recesses 18 are larger and in particular the central recess 18 extends completely through the bottom member 14 while the outer recesses are formed to extend partially into the bottom member 14. The top member 12 also includes an arcuate shape protrusion 20 that is complementary to a similar arcuate shape recess 22 and the bottom member. The top and bottom members 12 and 14 are interconnected with a living hinge portion 24 so that the top member may be folded onto the bottom member and locked in position using the arcuate shape protrusion 20 entering into the complementary recess 22 by frictional engagement.

As an alternative to the use of the living hinge 24, the top and bottom members 12 and 14 may be formed as two separate members and can be locked together using the actuate shape protrusion 20 entering into the complementary recess 22 by frictional engagement. Additionally, the top and bottom members 12 and 14 may be locked together using known means such as ultrasonic welding, hot welding, glue or a snap lock or the equivalent thereof.

At least one of the top and bottom members 12 and 14 includes a groove 26 extending from one side to the other side of the at least one of the top and bottom members. The groove 26 receives the ends of a strap so that first portions of the ends of the strap are within the groove 26. As will be seen with reference to FIGS. 3 and 4, second portions of the ends of the strap will extend outward from the sides of the clamp 10. The groove 26 has a depth 28 complementary to the thickness of the strap.

FIGS. 1B and 1C are similar in construction and in FIG. 1B, references numbers 30 to 48 represent complementary structures to that shown and described above with reference to FIG. 1A. Similarly in FIG. 1C, complementary reference numbers 50 to 68 also show complementary structures to that shown and described with reference to FIG. 1A.

The embodiments of FIGS. 1B and 1C are different primarily in the use of a pin members 40 and 60 in FIGS. 1B and 1C and complementary recesses 42 and 62 in FIGS. 1B and 1C. The pin member and recesses in FIG. 1B and FIG. 1C serve the same purpose as the arcuate member 20 and arcuate recess 22 in FIG. 1A.

Similar to the embodiment of FIG. 1A, as an alternative to the use of the living hinges 44 and 64, the top members 32 and 52 and bottom members 34 and 54 may be formed as two separate members and can be locked together using the pin members 40 and 60 in FIGS. 1B and 1C and complementary recesses 42 and 62 by frictional engagement. Additionally, the top members 32 and 52 and bottom members 34 and 54 be locked together using known methods such as ultrasonic welding, hot welding, glue or a snap lock.

Figure 2A:
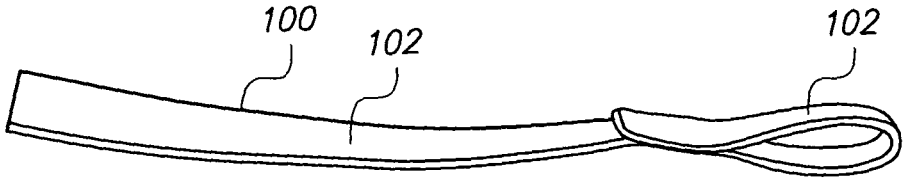
FIGS. 2A, 2B, 2C and 2D show four alternative structures for the ends of the strap member.
Figure 2B:
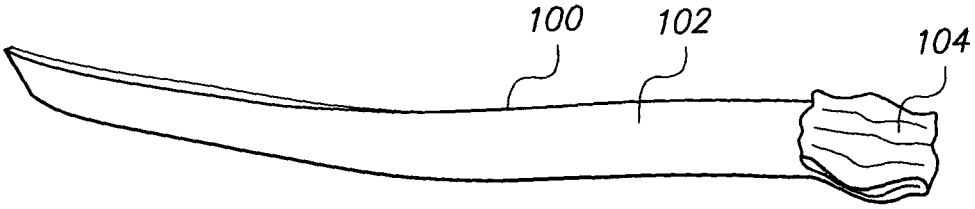
Figure 2C:
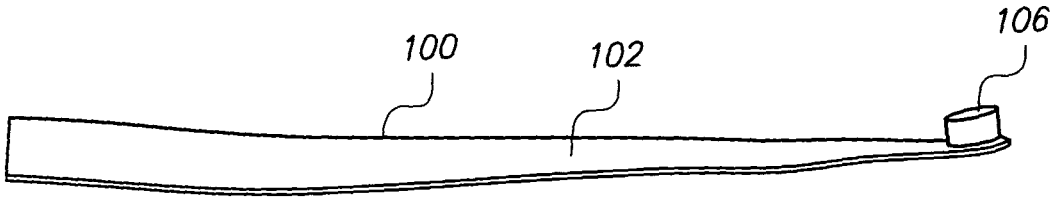
Figure 2D:
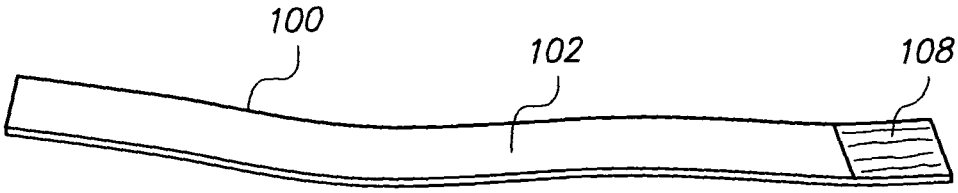

In using the clamp member such as shown in FIGS. 1A, 1B and 1C, it is important that the ends of the strap be held in position so that they cannot be easily removed once the clamp member is closed. To that end, a strap 100 may have alternate arrangements for an end 102 of the strap as shown in FIGS. 2A through 2D. These alternative arrangements increase the thickness of the ends of the strap so that the strap cannot be pulled completely through the clamp member. In FIG. 2A this can be accomplished by looping the end portion 102 of the strap 100 around on itself. In FIG. 2B an end 104 portion of the strap 100 can be folded over and glued in place. In 2C a member 106 can be adhered to the end of the strap 100. And in 2D an end portion 108 of the strap 100 may be infused with some material that increases the thickness of the end portion 108 of the strap 100.

Figure 3:
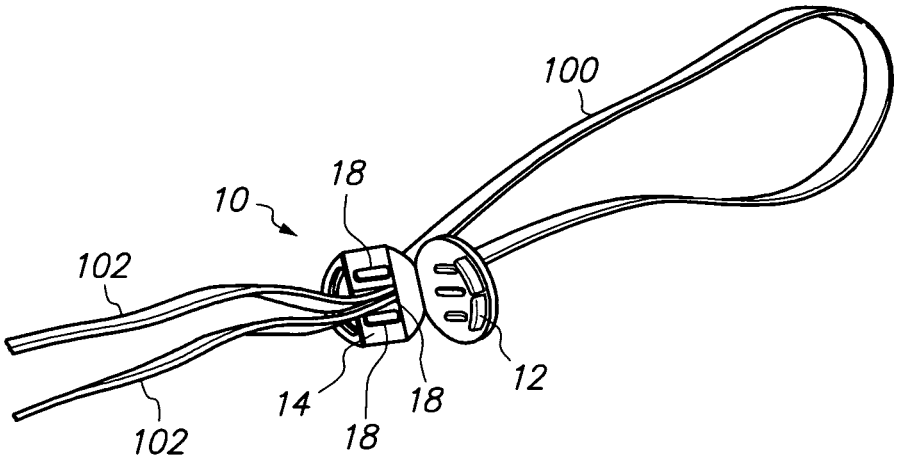
FIG. 3 illustrates the initial positioning of the ends of the strap member within the clamp before the clamp is closed.
Figure 4:
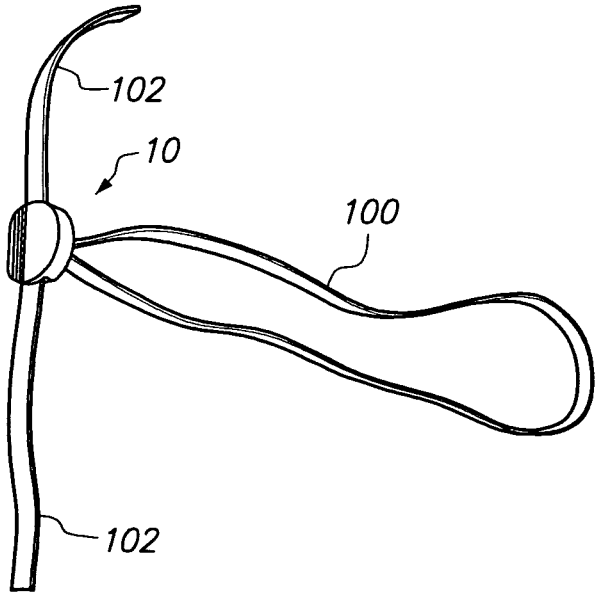
FIG. 4 illustrates the embodiment of FIG. 3 with the clamp in the closed position to lock the strap for adjustment.
Figure 5:
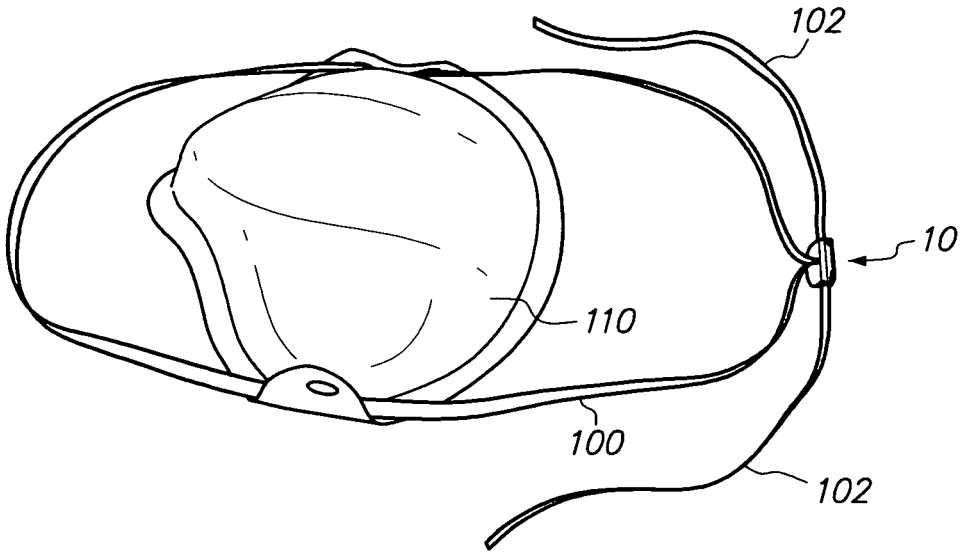
FIG. 5 illustrates the embodiment of FIGS. 3 and 4 as positioned on a respirator mask.

FIGS. 3, 4 and 5 illustrate a specific use of a strap member with a respirator. As shown in FIG. 3, two ends of the strap 100 may be inserted through the center recess 18 in the clamp 10 of FIG. 1A. The center recess 18 goes through the bottom member 14 for the clamp of FIG. 1A but the clamps 30 and 50 of FIG. 1B or FIG. 1C may also be used in a similar manner. Therefore, the ends of the strap are positioned through the opening 18 that goes completely through the bottom member 14 of the clamp 10. The ends 102 of the strap 100 are then folded down across the other openings 18 of the clamp 10 within the groove 26. As shown in FIG. 4, the ends 102 are held within groove 26 in a clamped position by closing the clamp 10 to interlock the top portion 12 with the bottom portion 14 as explained with reference to the description relative to FIG. 1A. The ends of the strap 10 are held within the clamp 10 by frictional engagement of the strap 100 by the top and bottom members 12 and 14.

As shown in FIG. 5, the strap may be positioned around a respirator 110 and in such a position the strap 100 may be used to hold the respirator against the face of the user of the respirator mask 110. When the ends 102 are pulled they can slide and thereby shorten this strap 100. If on the other hand the strap 100 were pulled from the bottom of the clamp 10, this would tend to lengthen the strap 100. In either event the strap can be adjusted because the strap member is held in fictional engagement by the clamp 10 and the force of pulling on the strap 100 can overcome the frictional engagement. It is important that with a respirator mask, the strap be adjustable so that the mask can be adjusted for better-fit and proper sealing to the face of the wearer and for comfort during use.

The frictional engagement of the strap can be increased by the use of the protrusions 16 relative to the recesses 18 to provide just enough frictional engagement to hold the strap in a desired position but not so hard that the strap cannot be slid relative to other portions of the strap to provide for the shortening and lengthening of the strap 10.

Figure 6:
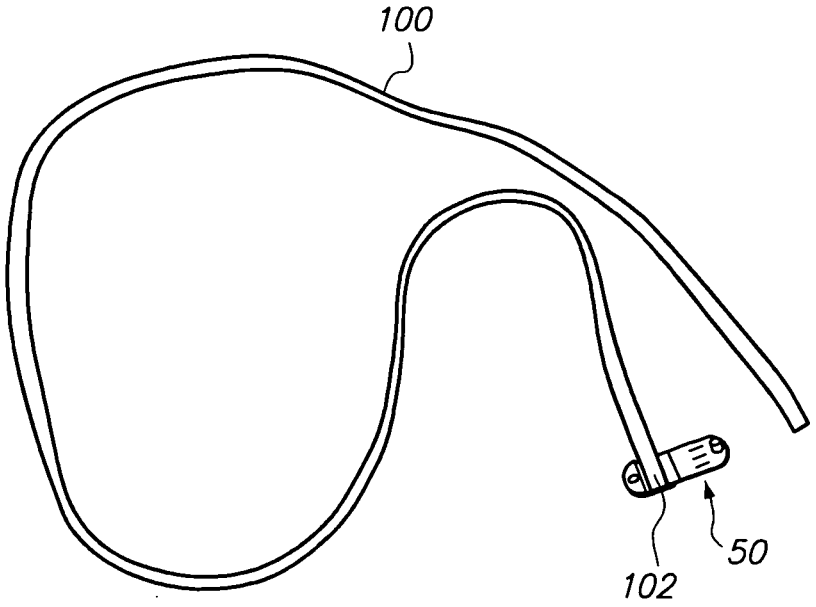
FIG. 6 illustrates a second embodiment of the invention used to have a single end of the strap adjustable.
Figure 7:
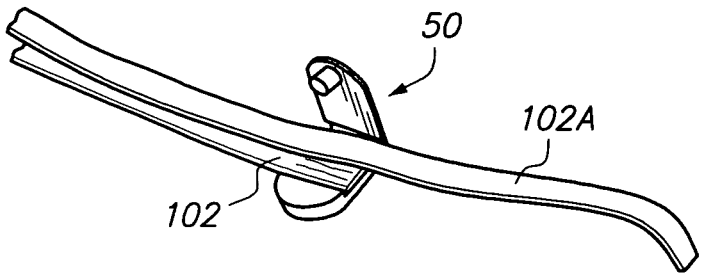
FIG. 7 illustrates the second embodiment of the clamp member showing the end of the strap in an intermediate position.
Figure 8:
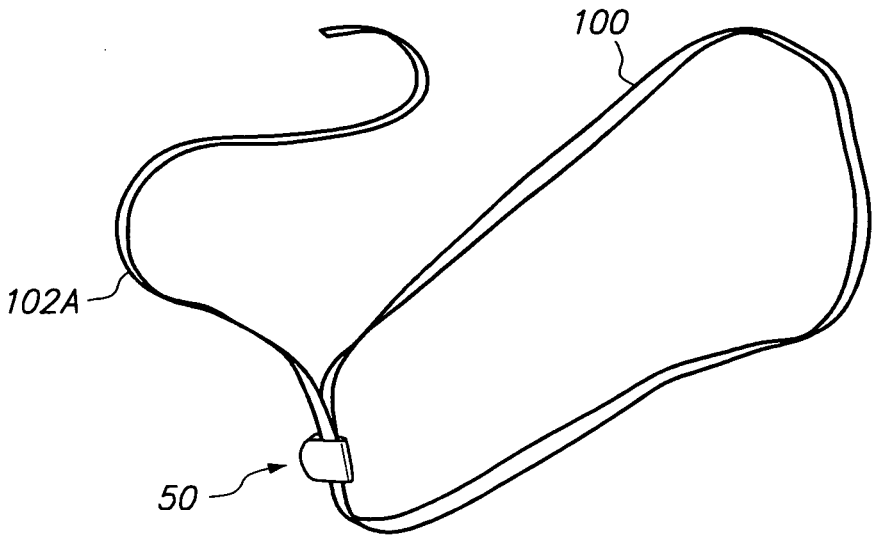
FIG. 8 illustrates the second embodiment with the clamp in the closed position and with the end of the strap now available for adjustment.

FIGS. 6, 7 and 8 show an alternative use of any of the clamps shown in FIG. 1 wherein only one end of the strap 100 is adjustable. FIGS. 6, 7 and 8 illustrate this second embodiment using specifically the embodiment of the clamp shown in FIG. 1C. The clamp shown in FIG. 1C will accommodate the strap member 100 not only being extended through the center opening 58 but will also allow the straps to lie side-by-side rather than along the same axis because of the increased width of the groove 66. This can be seen in FIG. 6 where one strap end 102 is shown laid into the groove 66 in clamp 50. In FIG. 7, the other end of the strap, which will be referred to as 102A, is now positioned side-by-side to the first end of the strap 102. In FIG. 8 the strap member 100 therefore has the end 102A extending from the clamp 50 and if this member is pulled in one direction it will shorten the strap 100. If it's pulled from the opposite side it lengthens the strap 100.

The clamps shown in FIG. 1A and FIG. 1B can be used to provide for a similar adjustment of the length of the strap 100 using only one end of the strap 100. This can be accomplished by either having a wider groove as shown in FIG. 1C, or by increasing the depth of the groove so that the ends of the strap can lie on top of each other.

Although the invention has been shown with reference to various embodiments, it should be appreciated that various adaptations and modifications may be made and the invention is only to be limited by the appended claims.

I claim:

1. A combination of a clamp and flat strap for use with a respirator mask for adjustably joining the ends of the flat strap to adjust the fit of the respirator mask to the face of a user, including a flat strap having ends, a clamping structure having top and bottom members, at least one of the top and bottom members having a groove extending from one side to the other side of the at least one of the top and bottom members and with the groove for receiving the ends of the flat strap so that first portions of the ends of the flat strap are within the groove and at least one other second portion of the ends of the flat strap extends outward from the sides of the clamping structure, complementary portions located on the top and bottom members to align the top and bottom members together to capture the first portions of the ends of the flat strap by friction within the groove formed within the clamp and with the length of the flat strap adjusted to be shorter or longer to adjust the fit of the respirator mask by the at least one other second portion of the ends of the flat strap that extend outward from the sides of the clamping structure, and means for locking the aligned top and bottom members together while still allowing the adjustment of the length of the flat strap to be shorter or loner to adjust the fit of the respirator mask.

2. The combination of claim 1 wherein both ends of the flat strap include second portions that extend outward from the sides of the clamping structure.

3. The combination of claim 1 wherein at least one of the top and bottom members includes an opening through the at least one of the top and bottom members into the groove so that the ends of the flat strap can pass through the opening into the groove and be locked in place by the top and bottom members.

4. The combination of claim 1 wherein the flat strap has a particular width and the groove has a complementary width to receive the ends of the flat strap along a single axis.

5. The combination of claim 1 wherein the flat strap has a particular width and the groove has a width greater than the particular width to receive the ends of the flat strap along parallel axes.

6. The combination of claim 1 wherein one of the top and bottom members include protrusions that extend partially within the groove to increase the friction within the groove of the captured portions of the ends of the flat strap.

7. The combination of claim 1 wherein one of the top and bottom members include protrusions that extend partially within the groove and the other of the top and bottom members include recesses complementary to the protrusions to increase the friction within the groove of the captured portions of the ends of the flat strap.

8. The combination of claim 1 wherein the top and bottom members are formed as one piece interconnected by a hinge portion so that after the flat strap is received within the groove, the top and bottom members may be aligned using the complementary portions by pivoting the top and bottom members around the hinge portion.

9. The combination of claim 1 wherein the top and bottom members are formed as two pieces so that after the flat strap is received within the groove, the top and bottom members may be aligned using the complementary portions by placing the top member on top of the bottom member.

10. The combination of claim 1 wherein the complementary portions include interlocking members as part of means for locking the aligned top and bottom members together to hold the top and bottom members together in the locked position.

11. The combination of claim 1 wherein means for locking the aligned top and bottom members together in the locked position includes using one or more of the following, an ultrasonic weld, a hot weld, glue or a snap lock.

* * * * *